US009770102B2

(12) United States Patent
Conod

(10) Patent No.: US 9,770,102 B2
(45) Date of Patent: Sep. 26, 2017

(54) FOLDABLE AND PORTABLE SHELVING

(71) Applicant: John W. Conod, Grand Island, FL (US)

(72) Inventor: John W. Conod, Grand Island, FL (US)

( * ) Notice: Subject to any disclaimer, the term of this patent is extended or adjusted under 35 U.S.C. 154(b) by 0 days.

(21) Appl. No.: 14/626,687

(22) Filed: Feb. 19, 2015

(65) Prior Publication Data

US 2015/0366338 A1 Dec. 24, 2015

Related U.S. Application Data

(60) Provisional application No. 61/918,300, filed on Dec. 19, 2013.

(51) Int. Cl.
*A47B 43/00* (2006.01)
*A47B 47/00* (2006.01)

(52) U.S. Cl.
CPC ..... *A47B 43/00* (2013.01); *A47B 47/0083* (2013.01)

(58) Field of Classification Search
CPC ..... A47B 5/04; A47B 46/00; A47B 96/025; A47B 2005/00; A47B 43/00; A47F 5/116; A47F 5/08
USPC ..... 108/134, 135, 48, 176, 179; 211/132, 211/149, 150, 201, 104, 118
See application file for complete search history.

(56) References Cited

U.S. PATENT DOCUMENTS 198,454 A * 12/1877 French ..... A47B 43/00 108/176
253,081 A * 1/1882 McKenzie ..... A47G 25/0685 211/104
355,227 A * 12/1886 Snyder ..... A47B 5/04 16/391
1,688,533 A * 10/1928 Eger ..... B25H 1/04 144/285
1,895,535 A * 1/1933 Brecht ..... A47F 5/108 211/126.1
2,305,629 A * 12/1942 Magnuson ..... A47B 43/00 108/134
2,316,433 A * 4/1943 Hulick ..... D06F 57/12 211/104
3,484,810 A * 12/1969 Boss ..... A47B 43/00 108/152
3,665,868 A * 5/1972 Kaeslin ..... A47B 5/04 108/29
4,111,309 A * 9/1978 Henry ..... A47B 61/02 211/104
5,775,655 A * 7/1998 Schmeets ..... A47B 5/00 108/115
5,819,670 A * 10/1998 O'Connor et al. ..... A47C 9/06 108/134
5,899,346 A * 5/1999 Newkirk ..... A47B 43/00 108/176

(Continued)

*Primary Examiner* — Janet M Wilkens

(74) *Attorney, Agent, or Firm* — Dunlap Bennett & Ludwig PLLC

(57) ABSTRACT

A folding shelf apparatus is provided. The folding shelf includes forward vertical supports and rearward vertical supports. At least one horizontal shelf is pivotally mounted to the forward supports and the vertical supports so that the shelf of the present invention may fold. The present invention further includes at least one wall mount that is attachable to a wall, and at least one latch protruding from the folding shelf and releasably attachable to the wall mount.

5 Claims, 4 Drawing Sheets

(56) References Cited

U.S. PATENT DOCUMENTS 7,651,065 B2 * 1/2010 Sloan ..... A47B 43/003
211/90.01

* cited by examiner

FOLDABLE AND PORTABLE SHELVING

CROSS-REFERENCE TO RELATED APPLICATION

This application claims the benefit of priority of U.S. provisional application No. 61/918,300, filed Dec. 19, 2013, the contents of which are herein incorporated by reference.

BACKGROUND OF THE INVENTION

The present invention relates to shelving and, more particularly, to foldable and portable shelving.

During the process of transporting cargo through the use of various box/cargo trucks and enclosed trailers of multiple sizes, it is difficult to safely and efficiently segregate or organize the products that are being transported. The existing shelving units that are available lack the convenient means to be portable, and foldable as necessary or needed. The shelves are made of substandard material, and are unsafe, bulky, heavy, non-versatile and permanently fixed.

As can be seen, there is a need for a foldable and portable shelving system.

SUMMARY OF THE INVENTION

In one aspect of the present invention, a folding shelf apparatus comprises: forward vertical supports; rearward vertical supports; at least one horizontal shelf pivotally mounted to the forward vertical supports and the rearward vertical supports; at least one wall mount configured to attach to a wall; and at least one latch protruding from the folding shelf and releasably attachable to the at least one wall mount.

These and other features, aspects and advantages of the present invention will become better understood with reference to the following drawings, description and claims.

DETAILED DESCRIPTION OF THE INVENTION

Figure 1:
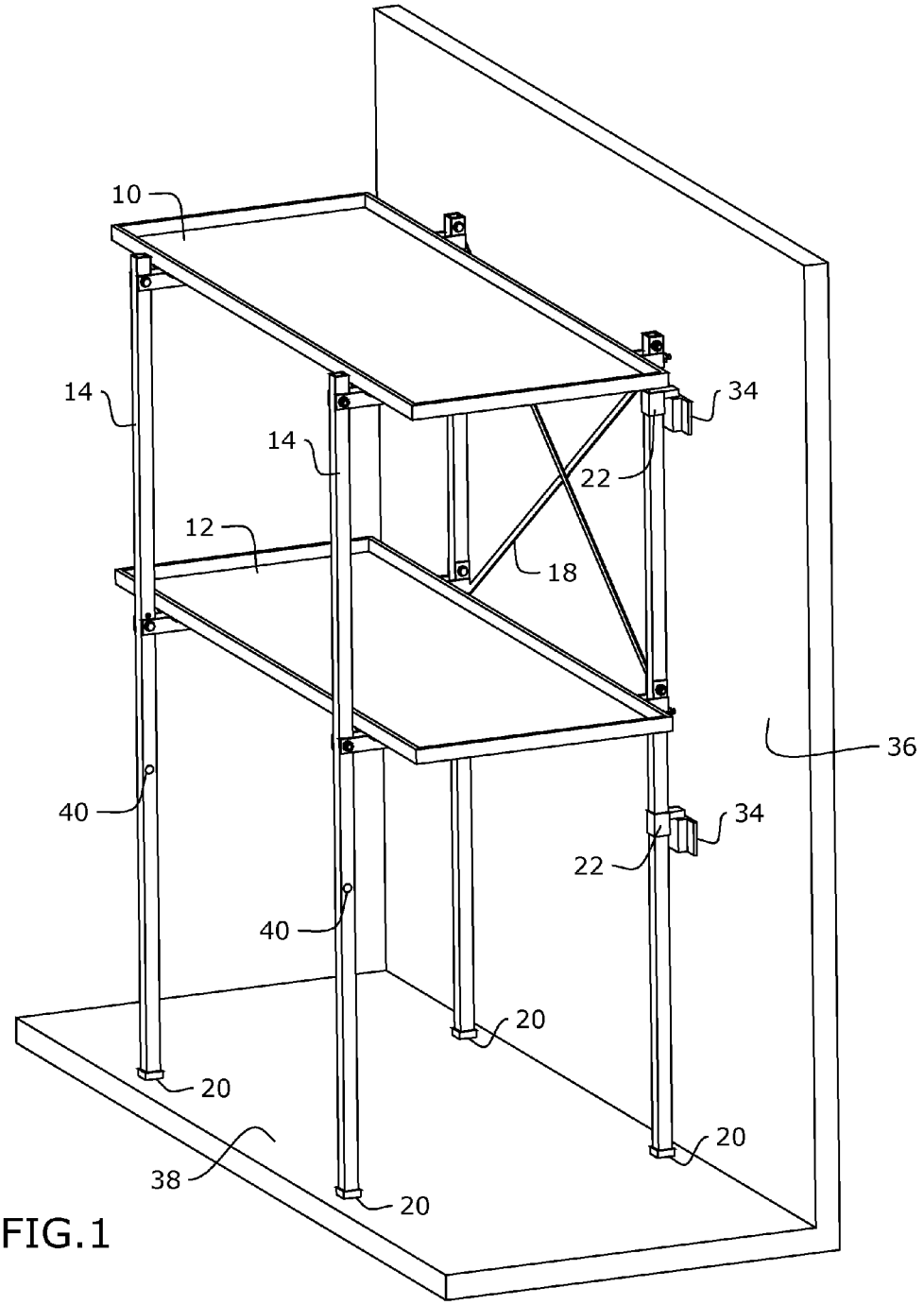
FIG. 1 is a perspective view of the present invention in a fully expanded position.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a portable, fold-able, shelving system designed for cargo transportation and/or storage. The shelving units of the present invention may simply fold and lock flat against the wall, or easily removed in the event that space for bulk loads is needed.

The present invention may include shelving pans (shelves) manufactured in various lengths and depths according to application. The present invention may include support legs (vertical supports), such as 1" Square or round aluminum tubing. The present invention may include shelf pan hinge brackets (horizontal supports) connecting the legs to the shelf pan. The present invention may include a cross support brace in the shape of an "X" to stabilize the shelving unit system. The present invention may include adjustable mounting brackets (latch) attached to the leg supports to connect the shelving unit to the walls of a vehicle/trailer/building or unit. The present invention may further include nuts and bolts to fasten the shelves to the leg supports, and locking pins to secure the shelf in the retracted position. The present invention may be made of aluminum. However, alternative materials may include wood, plastics, composites, steel, stainless steel, and/or fiberglass.

Referring to FIGS. 1 through 9, the present invention includes a folding shelf apparatus. The folding shelf includes forward vertical supports 14 and rearward vertical supports 16. At least one horizontal shelf 10, 12 is pivotally mounted to the forward supports 14 and the vertical supports 16 so that the shelf of the present invention may fold. The present invention further includes at least one wall mount 34 that is attachable to a wall 36, and at least one latch 22 protruding from the folding shelf and releasably attachable to the wall mount 34.

As illustrated in the Figures, the present invention may include two forward vertical supports 14 and two rearward vertical supports 16 supporting the shelf in an upright and vertical position. The bottom ends of the vertical supports 14, 16 may include rubber bumpers 20 to reduce the stress of impact. The present invention may further include cross beams 18 attaching the two rearward vertical supports 16 together. The cross beams 18 add strength to the foldable shelf.

Figure 5:
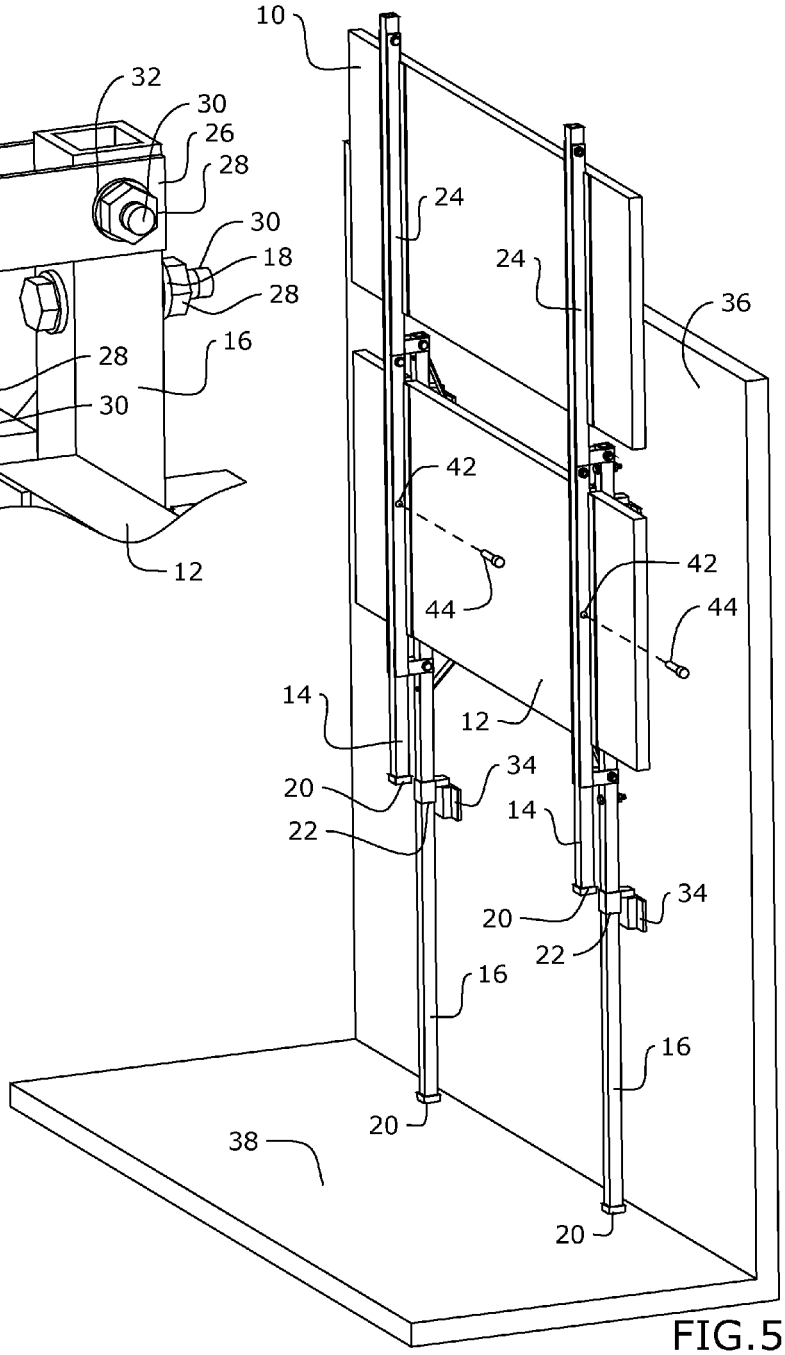
FIG. 5 is a perspective view of the present invention in a fully retracted position.
Figure 7:
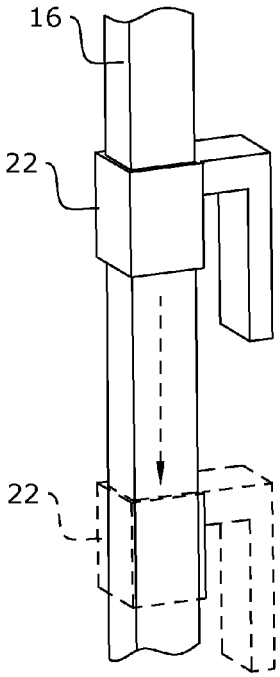
FIG. 7 is a detail perspective view of the present invention demonstrating sliding action of the latch.
Figure 8:
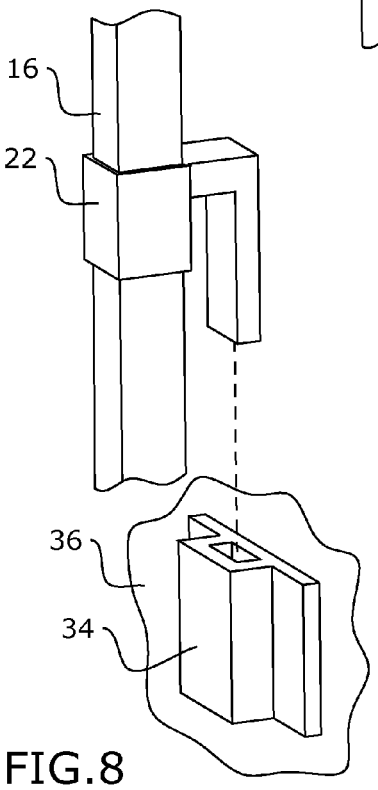
FIG. 8 is a detail exploded view demonstrating insertion of the latch into wall mount.
Figure 9:
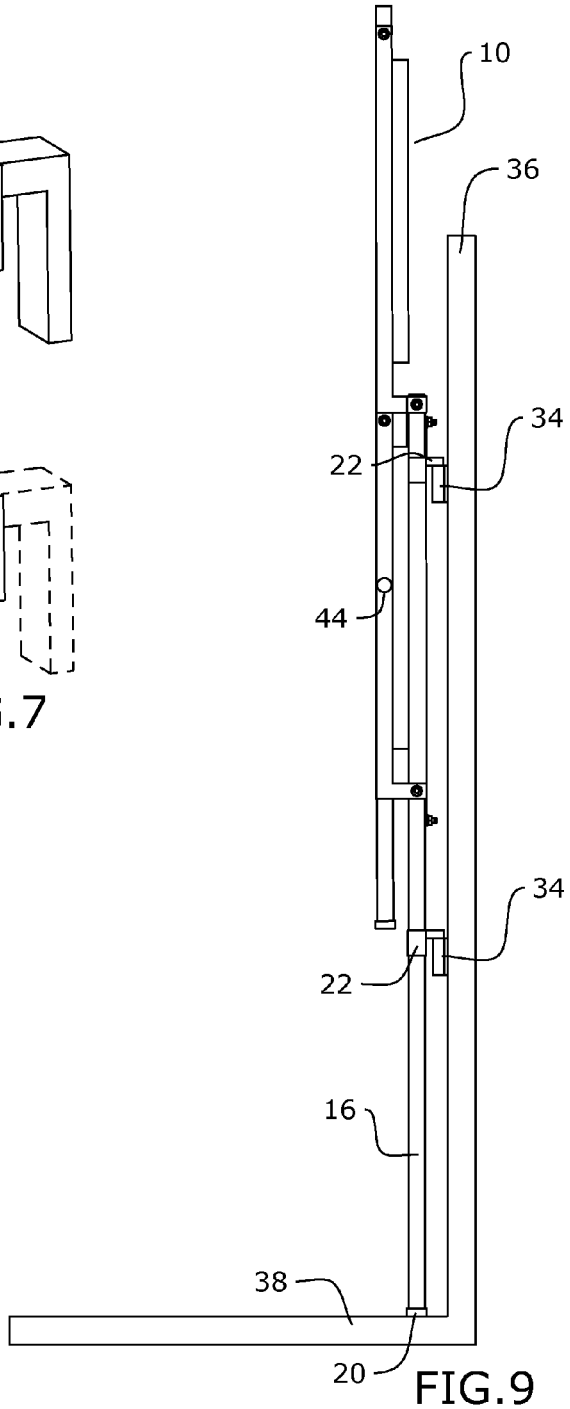
FIG. 9 is a side view of the present invention shown in a fully retracted position.

The present invention includes an expanded form and a retracted form. As illustrated in FIG. 1, the expanded form includes the horizontal shelves 10, 12 pivoted away from and substantially perpendicular to the rearward vertical supports 16. The bottoms of the forward vertical supports 14 are resting against a surface 38. Storage items may be placed on the horizontal shelves 10, 12 and stored in the expanded form. As illustrated in FIG. 5, the retracted form includes the horizontal shelves 10, 12 pivoted towards and substantially parallel to the rearward vertical supports 16. The bottoms of the forward vertical supports 14 are lifted above the surface 38. A locking mechanism 40, 42, 44 is operable to lock the folding shelf in the retracted form. Therefore, the foldable shelves may be folded into the retracted form to increase space or the foldable shelves may be detached from the wall mount 34 and transported.

In certain embodiments, the present invention may include horizontal supports 24. The horizontal supports 24 may include an upper pair of horizontal supports 24 and a lower pair of horizontal supports 24. Each of the horizontal supports 24 may include a first end and a second end. The first end is pivotally connected to one of the forward vertical supports 14 and the second end is pivotally connected to one of the rearward vertical supports 16. A top horizontal shelf 10 may be attached to the upper pair of horizontal supports and a bottom horizontal shelf 12 may be attached the lower pair of horizontal supports 12, thereby pivotally connecting the shelves 10, 12 to the vertical supports 14, 16. The shelves 10, 12 may include pans having a substantially flat upper surface and a vertical sidewall extending from a substantial portion of an outer periphery of the substantially flat upper surface forming a lipped edge to prevent cargo from sliding off and for reinforcement.

Figure 2:
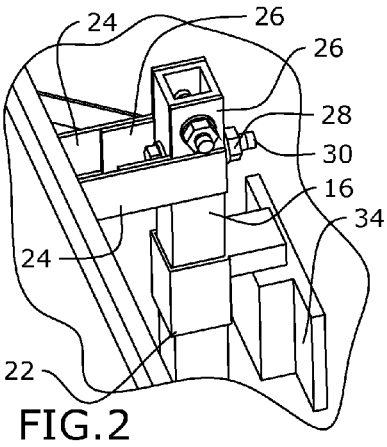
FIG. 2 is a detail perspective view of the rear hinge joint in a fully expanded position
Figure 4:
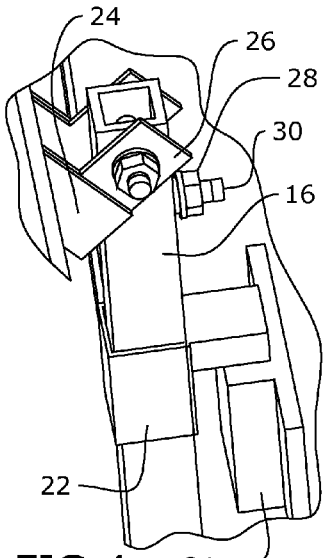
FIG. 4 is a detail perspective view of the rear hinge joint shown in a partial retracted position.
Figure 3:
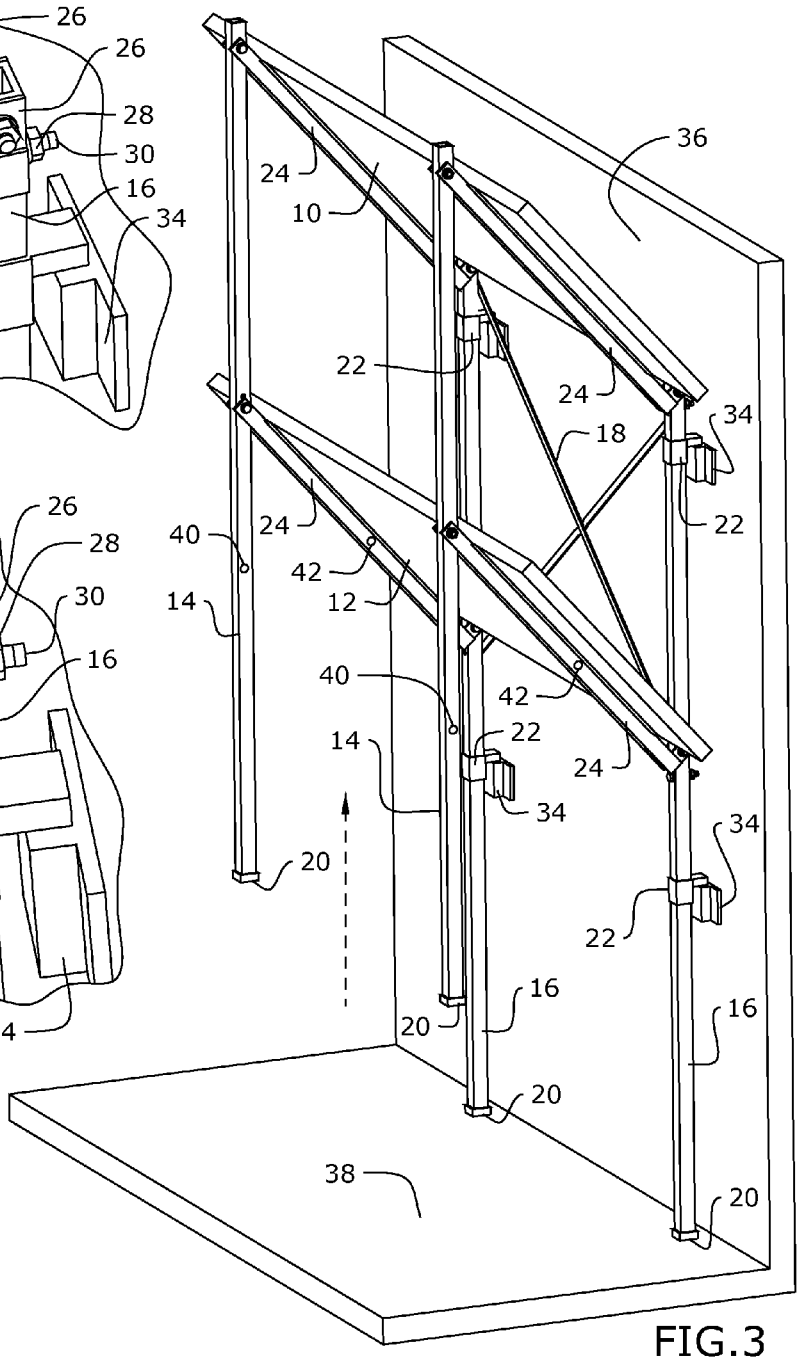
FIG. 3 is a perspective view of the present invention in a partial retracted position.
Figure 6:
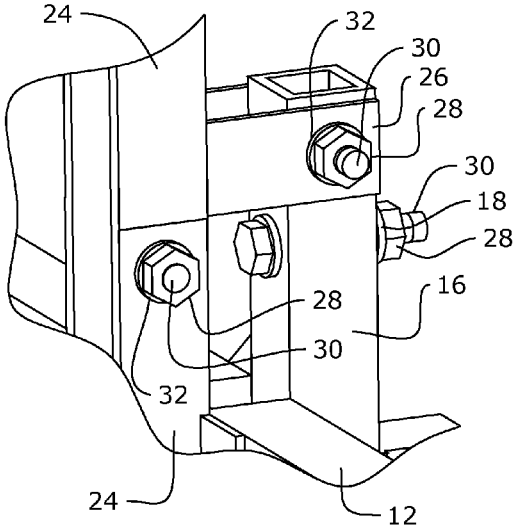
FIG. 6 is a detail perspective view of the present invention in a fully retracted position.

As illustrated in FIGS. 2 and 3, the horizontal supports 24 may be pivotally attached to the rearward vertical supports 16 by an L-bracket 26. The L-bracket 26 may be pivotally connected to the rearward vertical supports 16 by nuts 28, bolts 30 and washers 32. Further, the other pivotal connections may be facilitated by the nuts 28, bolts 30 and washers 32. To pivot from the expanded position to the retracted position, the L-brackets 26 may swing upwards. The horizontal supports 24 may include channels on the underside. The L-brackets 26 provide enough space so that the forward vertical supports 14 may pivot into the channels of the horizontal supports 24 so that the forward vertical supports 14 remain parallel with the rearward vertical supports 14 in the retracted position. The locking mechanism 40, 42, 44 may lock the forward vertical supports 14 within the horizontal supports 24, preventing the folding shelf from pivoting back to the expanded position. As illustrated in the Figures, the forward vertical supports 14 may include apertures 40 that align with apertures 42 of the horizontal supports 24 when in the retracted position. A pin 44 may fit through the apertures 40, 42 to lock the folding shelf into the retracted position.

In certain embodiments, the at least one latch 22 may include a plurality of hooks attached to and extending from the rearward vertical supports 16. Further, the hooks may be slidably engaged with the rearward vertical supports 16 for adjustment. The at least one wall mount 34 may include a plurality of wall mounts 34 each having a slot sized to receive and secure one hook within.

It should be understood, of course, that the foregoing relates to exemplary embodiments of the invention and that modifications may be made without departing from the spirit and scope of the invention as set forth in the following claims.

What is claimed is:

1. A folding shelf apparatus comprising:

forward vertical supports;

rearward vertical supports;

a pair of upper horizontal supports and a pair lower horizontal support, wherein each of the horizontal supports comprises a first end and a second end and a channel formed on an underside, wherein the first end is pivotally connected to one of the forward vertical supports and the second end is pivotally connected to one of the rearward vertical supports;

a first horizontal shelf attached to the pair of upper horizontal supports and a second horizontal shelf attached to the pair of lower horizontal supports wherein each of the first and second horizontal shelves are pans comprising a substantially flat upper surface and a vertical sidewall extending from a substantial portion of an outer periphery of the substantially flat upper surface forming a lipped edge; and an expanded form comprising the pair of upper horizontal supports and the pair of lower horizontal supports pivoted downwards and away from the rearward vertical supports, and a retracted form comprising the pair of upper horizontal supports and the pair of lower horizontal support pivoted upwards and towards the rearward vertical supports so that one of the forward vertical supports is disposed within the channels of one of the pair of upper horizontal supports and one of the pair of lower horizontal supports and the other of the forward vertical supports is disposed within the other of the pair of upper horizontal supports and the other of the pair of lower horizontal supports.

2. The folding shelf apparatus of claim 1, wherein the pair of upper horizontal supports and the pair of lower horizontal supports are pivotally connected to the rearward vertical supports by an L-bracket.

3. The folding shelf apparatus of claim 1, further comprising cross beams connecting the rearward vertical supports together.

4. The folding shelf of apparatus claim 1, further comprising at least one latch protruding from each of the rearward vertical supports and releasably attachable to a wall mount secured to a wall.

5. The folding shelf apparatus of claim 4, wherein the at least one latch comprises a plurality of hooks attached to and extending from the rearward vertical supports and the at least one wall mount comprises a plurality of wall mounts each comprising a slot sized to receive and secure one of the hooks within.

* * * * *